United States Patent [19]

Gallagher

[11] Patent Number: 4,787,626

[45] Date of Patent: Nov. 29, 1988

[54] SIT-UP SUPPORT DEVICE

[76] Inventor: Timothy Gallagher, 1040 6th St. #7, Novato, Calif. 94945

[21] Appl. No.: 882,151

[22] Filed: Jul. 3, 1986

[51] Int. Cl.[4] ..... A63B 23/02

[52] U.S. Cl. ..... 272/93; 272/900

[58] Field of Search ..... 272/93, 900; 292/339; 70/94; 254/39

[56] References Cited

U.S. PATENT DOCUMENTS

| | | | |
|---|---|---|---|
| 1,332,473 | 3/1920 | Shirley | 292/339 |
| 4,182,510 | 1/1980 | Lundell | 272/93 |
| 4,185,816 | 1/1980 | Bernstein | 272/93 |
| 4,212,458 | 7/1980 | Bizilia | 272/93 |

*Primary Examiner*—Richard J. Apley
*Assistant Examiner*—J. Welsh

[57] ABSTRACT

This sit-up support device is designed to hold a person's feet when they are performing bent knee sit-ups. Primarily, it consists of a base plate that is rendered stationary to the floor by a clamp that fastens to a door. The device also includes quick-release straps on the base plate, for comfortably holding the user's feet, and a threaded shaft and sleeve are provided in conjunction with the clamp, to force the base plate hard down to the floor.

4 Claims, 1 Drawing Sheet

FIG. 1
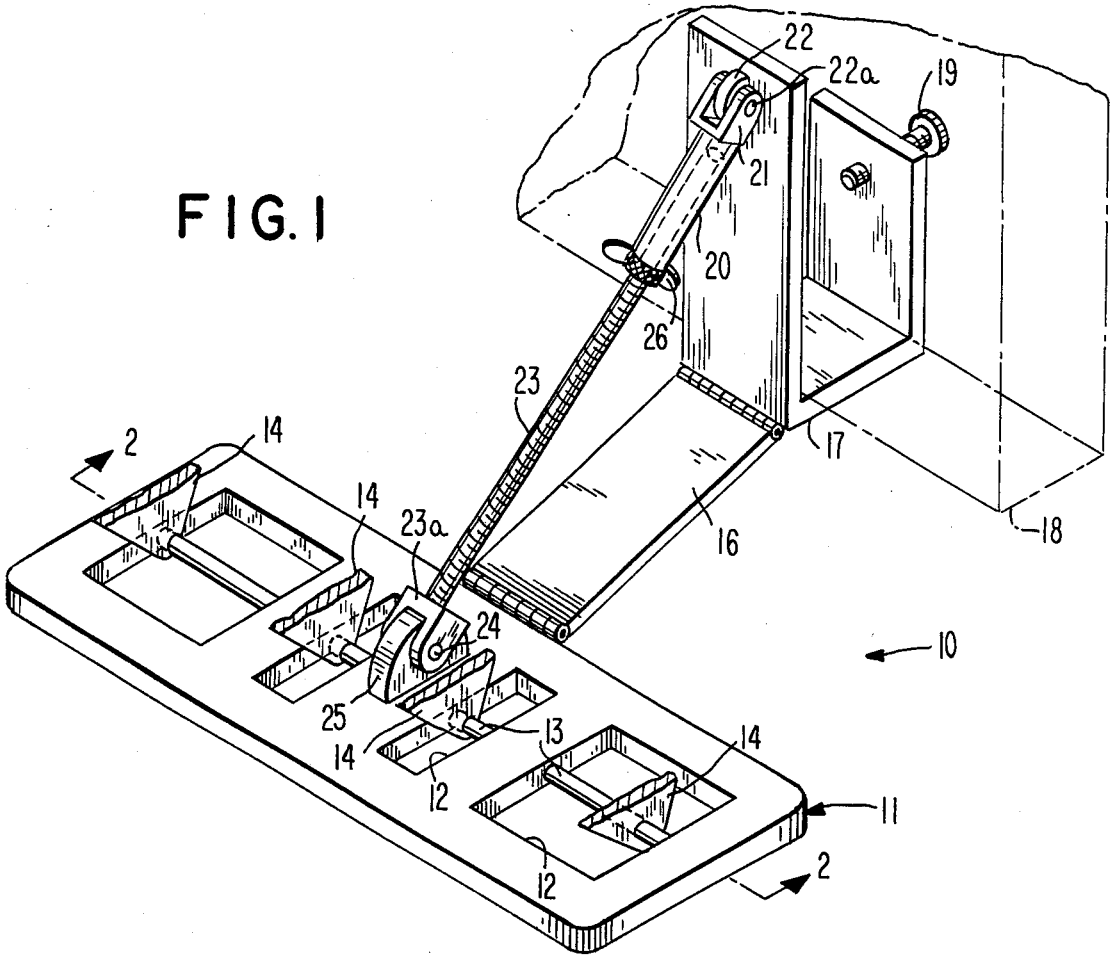
FIG. 2
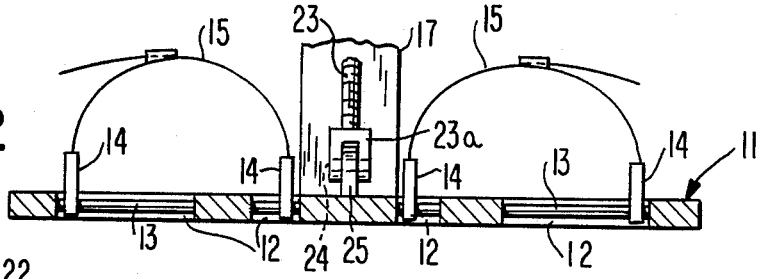
FIG. 3
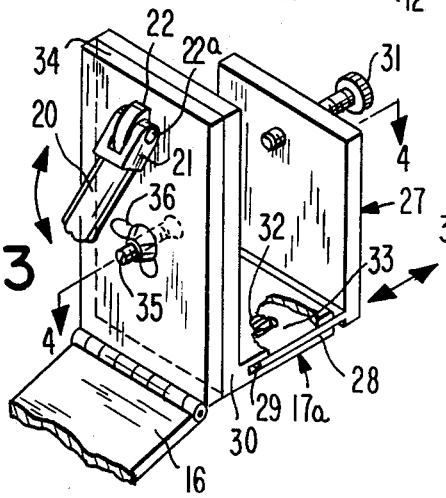
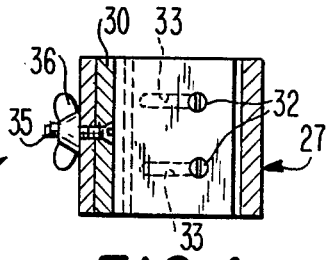
FIG. 4
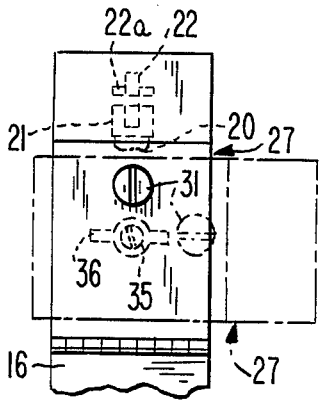
FIG. 5

SIT-UP SUPPORT DEVICE

BACKGROUND OF THE INVENTION

1. Field of the Invention

This invention relates to devices for physical fitness, and more particularly, to a sit-up support device.

2. Description of Prior Art

Devices have been devised to aid in physical fitness and are of several kinds. The sit-up support device in accordance with the present invention, is designed to be used as a support for the feet when doing bent knee sit-ups, and is employed anywhere there is a door to clamp it to.

The principal object of this invention is to provide a sit-up support device, which will be employed as a support for one's feet when doing bent knee sit-ups.

Another object of this invention is to provide a sit-up support device, which will be of such design, as to clamp to a door and hold the user's feet comfortably and securely in place by means of quick-release straps, and it will hold any size foot or shoe.

BRIEF DESCRIPTION OF THE DRAWINGS

FIG. 1 is a perspective view of the present invention, showing the straps partly broken away;

FIG. 2 is a cross-sectional view, taken along the line 2—2 of FIG. 1;

FIG. 3 is a fragmentary perspective view of a modified form of door clamp for the invention;

FIG. 4 is a cross-sectional view, taken along the line 4—4 of FIG. 3, and FIG. 5 is a rear view of FIG. 3, shown in elevation and illustrating the clamp rotated ninety degrees in phantom lines.

SUMMARY OF THE INVENTION

A sit-up support device attachable to a door, comprising a base with a door clamp attached and including hinge means. The base further includes adjustable strap means for holding the feet of the user.

DETAILED DESCRIPTION

Accordingly, a device 10 is shown to include a rectangular base 11 having spaced cut-outs 12 therethrough. A rod 13 transverses the cut-outs 12 and strap brackets 14 are received on rod 13 and brackets 14 are secured to quick-release and adjustable straps 15 that are provided for holding the user's feet, whether they are in shoes or not. A hinge 16 is fixedly secured to one longitudinal side edge of base 11 at one end and is similarly secured to the bottom of a "U"-shaped clamp 17 that is designed to be received under a door 18 to hold device 10 stationary to the floor. Clamp 17 is provided with a set screw 19 for fastening clamp 17 to the door 18, and an internally threaded sleeve 20 is provided with an end fork 21 that is pivotally secured to a bracket 22 by a pin **22*a*. Bracket 22 is fixedly secured to clamp 17 and sleeve 20 threadingly receives a threaded shaft 23 that has a fork 23*a* fixedly secured to one end. A pivot pin 24 is received through fork 23*a* and a bracket 25 which is fixedly secured to the top center of base 11, and a knurled wing nut 26 is provided on shaft 23, so as to lock the adjustment of shaft 23 in sleeve 20 when nut 26 is in engagement with the bottom end of sleeve 20**.

In use, device 10 clamps to the bottom of the door 18 by tightening the clamp 13 with the screw 19. The shaft 23 and the sleeve 20 are telescopingly adjusted until the base 11 is securely pressed to the floor. After the above have been effected, the user places both feet on the base 11 and places the nylon straps 15 thereon, and tightens straps 15 to a point where they are comfortable to the user.

Referring now to FIGS. 3, 4, and 5, a modified clamp **17*a* is shown to include a first "L"-shaped member 27, the tongue 28 of which is slideably received in a slot 29 of a second "L"-shaped member 30. Members 27 and 30 are received on door 18 and a set screw 31 is provided through member 27 for tightening on door 18. Members 27 and 30 are adjustable to and away from each other, for clamping to doors 18 of various thicknesses and are fixed in any desired width apart by means of the two fasteners 32 received in the elongated slots 33 of tongue 28. A third member 34 engages with second member 30 and is fastened thereto, by a bolt fastener 35 receiving a wing nut 36. In this instance, bracket 22 is fixedly secured to a face of third member 34, rather than the clamp 17 heretofore described, and the sleeve 20** is also the same as was described.

In use, modified clamp **17*a* functions in the same manner, as was described of clamp 17, with the exception, that it is adjustable to fit doors 18 of various thicknesses and member 27** is pivotal.

While various changes may be made in the detail construction, such details will be within the spirit and scope of the present invention, as defined by the appended claims.

What is claim is:

1. A sit-up support device comprising, a substantially rectangular base including foot strap means, a clamp adapted to be secured to a door bottom by clamp screw means, hinge means pivotally connecting said base to said clamp, and an adjustable length shaft means connected between said base and said clamp so as to prevent upward movement of said base.

2. A sit-up support device as set forth in claim 1, wherein a plurality of cut-out openings are provided through said base and a rod is received in said base and traverses the cut-out openings for attaching said strap means to said base and said strap means comprising, a pair of straps for engaging a user's feet.

3. A sit-up support device, as set forth in claim 1, wherein said adjustable length shaft means comprises an internally threaded sleeve and an externally threaded shaft telescopically received in said sleeve, and a knurled wing nut received on said shaft which is rotated to engage against said sleeve to lock said base against upward movement.

4. A sit-up device, as set forth in claim 3, wherein the ends of said adjustable length shaft means are forked so as to pivotally attach to brackets on said base and said clamp.

* * * * *